US006919783B2

(12) United States Patent
Dionne et al.

(10) Patent No.: US 6,919,783 B2
(45) Date of Patent: Jul. 19, 2005

(54) TUNABLE MICROWAVE MAGNETIC DEVICES

(75) Inventors: Gerald F. Dionne, Winchester, MA (US); Daniel E. Oates, Belmont, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/131,338

(22) Filed: Apr. 23, 2002

(65) Prior Publication Data

US 2003/0197576 A1 Oct. 23, 2003

(51) Int. Cl.[7] ..... H01P 1/20
(52) U.S. Cl. ..... 333/205; 333/219
(58) Field of Search ..... 333/148, 219, 333/227, 202, 204, 205, 186–192; 310/26

(56) References Cited

U.S. PATENT DOCUMENTS

| | | | | |
|---|---|---|---|---|
| 3,543,058 A | * | 11/1970 | Klemens | 310/322 |
| 4,137,470 A | * | 1/1979 | Desormiere et al. | 310/26 |
| 4,785,269 A | * | 11/1988 | Adam et al. | 333/188 |
| 4,853,660 A | | 8/1989 | Schloemann | 333/204 |
| 5,949,311 A | | 9/1999 | Weiss et al. | 333/202 |
| 6,141,571 A | | 10/2000 | Dionne | 505/210 |
| 6,279,406 B1 | | 8/2001 | Li et al. | 73/861.27 |

OTHER PUBLICATIONS

D. E. Oates, et al. "Magnetically Tuned Superconducting Filters", Mat. Res. Soc. Symp. Proc. vol. 603, 2000 Materials Research Society, pp. 113–118.

Gerald F. Dionne, "Effect of External Stress on Remanence Ratios and Anisotropy Fields of Magnetic Materials", IEEE Transactions on Magnetics, vol. MAG–5, No. 8, Sep. 1969, pp. 596–600.

D. E. Otes et al. "Tunable Superconducting Resonators Using Ferrite Substrates", Lincoln Laboratory, Massachusetts Institute of Technology, IEEE, Jun. 1997, 4 pgs.

Gerald F. Dionne, et al. "Ferrite–Superconductor Devices for Advanced Microwave Applications", IEEE Transactions on Microwave Theory and Techniques, vol. 44, No. 7, Jul. 1996, pp. 1361–1368.

Gerald F. Dionne, et al. "Magnetic Design for Low–Field Tunability of Microwave Ferrite Resonators", Journal of Applied Physics, vol. 85, No. 8, Apr. 15, 1999, pp. 4856–4858.

Gerald F. Dionne, et al. "Tunability of Microstrip Ferrite Resonator in the Partially Magnetized State", IEEE Transactions on Magnetics, vol. 33, No. 5, Sep. 1997, pp. 3421–3423.

Gerald F. Dionne, "Conditions For Stress–Induced Uniaxial Anisotropy in Magnetic Materials of Cubic Symmetry", Materials Research Bulletin, vol. 6, No. 9, Jul. 1, 1971, pp. 805–816.

Kurtzig; "Noncubic Magnetic Anisotropies in Bulk and Thin–Firm Garnets;" 1971 Intermag Converence; IEEE Transactions on Magnetics; Sep. 1971; pp. 473–476.

Braginski et al.; "Domain Structure and Stress in Epitaxial YIG Films;" 1972 Intermag Conference; IEEE Transactions on Magnetics; Sep. 1972; pp. 300–303.

* cited by examiner

*Primary Examiner*—Minh Nguyen
(74) *Attorney, Agent, or Firm*—Daly, Crowley, Mofford & Durkee, LLP

(57) ABSTRACT

A device responsive to an electromagnetic signal includes a conductor for conducting the electromagnetic signal, a magnetic structure disposed proximate the conductor to enable gyromagnetic interaction between the electromagnetic signal and the magnetic structure and a transducer disposed on the magnetic structure for controlling a domain pattern in the magnetic structure.

28 Claims, 8 Drawing Sheets

TUNABLE MICROWAVE MAGNETIC DEVICES

STATEMENTS REGARDING FEDERALLY SPONSORED RESEARCH

This invention was made with government support under AF Contract No. F-9628-00-C-0002 awarded by the Department of the Navy. The government has certain rights in the invention.

FIELD OF THE INVENTION

This invention relates generally to devices which operate in the microwave and millimeter wave frequency ranges and more particularly to devices whose operation depends upon a gyromagnetic effect.

BACKGROUND OF THE INVENTION

In communications and radar systems applications, it is often desirable to control radio frequency (RF) signals with a variety of RF devices. Tunability of RF devices at microwave and millimeter wave frequencies is desirable for a variety of civilian and military applications. It has been recognized that the integration of ferrimagnetic, ferromagnetic and superconductor materials in microstrip configurations could improve tunable devices by providing the device with new capabilities such as lower loss and simpler geometries that reduce size and cost.

A ferromagnetic material (also referred to as a "ferromagnet") is a substance (e.g. iron, nickel cobalt, other metals and various alloys) that exhibits extremely high magnetic permeability, the ability to acquire high magnetization in relatively weak magnetic fields, a characteristic saturation point, and a magnetic hysteresis. A ferrimagnetic material (also referred to as a "ferrite") is a substance (e.g. iron oxides) that possesses magnetic properties comparable in some respects to the magnetic properties of ferromagnetic substances. Although the magnetic strength of ferrites tends to be weaker than that of the ferromagnetic metals, an important and distinguishing feature of ferrites is that they exhibit a dielectric or electrical insulating property. For this reason, ferrites are particularly well suited for applications where electrical conduction is to be avoided.

Ferrimagnetic and ferromagnetic material (also referred to as spontaneous magnetic material) are also gyrotropic media that can influence the propagation of an electromagnetic wave or signal. If the electromagnetic wave has a relatively high frequency, including a frequency in the microwave and millimeter wave frequency bands, a gyromagnetic interaction occurs between the magnetization of the spontaneous magnetic material and the magnetic field component of the electromagnetic wave of the proper polarization traversing the spontaneous magnetic material. At a specific frequency that is proportional to the strength of the internal magnetic field, the interaction becomes resonant and the electromagnetic wave undergoes dispersion and absorption by the spontaneous magnetic material across a narrow band about the resonance frequency. At frequencies away from the gyromagnetic resonance condition, the absorption becomes negligible but a dispersion effect remains in the wave. This dispersion causes a change in the velocity of propagation that produces phase shift in the electromagnetic signal. This property is utilized in phase shifters, switchable circulators and tunable filters. The absorption near resonance is utilized in other devices such as switches, variable attenuators, and tunable absorption filters.

The amount of gyromagnetic interaction is proportional to the magnetization in the spontaneous magnetic material whether at resonance or away from resonance. Magnetization in a conventional polycrystalline ferrite structure exhibits hysteresis. The term hysteresis means that changes in the magnetic state of the spontaneous magnetic material structure induced by a magnetic field are not directly reversible by removal of the field. For this reason, the shape and stability of the hysteresis loop are of critical importance to device performance that depends on a variable magnetization at low magnetic fields.

Polycrystalline materials are dense and comprise many individual crystals usually, but not necessarily, of random crystallographic orientation. Modem polycrystalline microwave magnetic devices are commonly operated in a remanent state and are designed to accommodate the hysteresis loop phenomenon. An initial negative magnetic field pulse drives the device into reverse magnetic saturation and a second positive magnetic field pulse selects an appropriate magnetization level of a minor hysteresis loop such that when the second pulse is removed, the device settles into a desired remanent magnetization.

This technique to obtain a desired remanent magnetization suffers from several limitations. First, it requires a look-up table to determine appropriate magnetic field pulse strength to cause the device to settle into a particular magnetization. Second, devices provided from polycrystalline materials suffer from high coercivity and therefore, energy is wasted when switching between magnetization states. Third, the hysteresis characteristics of such devices require relatively large amounts of energy to reset the device into saturation. Fourth, the switching time between pulses cannot be reduced below several microseconds without utilizing current drive pulses having relatively high current levels. Magnetic saturation is necessary in order to achieve a full range of tunability. Magnetic saturation further requires a relatively large amount of current and inductance in the magnetizing driver circuit.

One method for greatly reducing the inefficiencies and uncertainties introduced by the hysteresis loops exhibited by polycrystalline devices is the use of single-crystal ferrite structures. A single-crystal material has distinct preferred directions of magnetization uniformly throughout the material and exhibits virtually no hysteresis in its magnetization curve. In single-crystal devices the magnetization can be crystallographically aligned with the preferred directions, in other words along the "easy" axes, in order to eliminate, or nearly eliminate, the hysteresis loop. This leads to a device which exhibits negligible coercivity and therefore has a magnetization which is nearly directly reversible. For single-crystal devices, departure from alignment with the easy axis increases the energy required to magnetize the material.

To overcome some of the limitations described above, frequency tuning in recent microwave ferrite resonators and filters having planar geometries is accomplished by varying the magnetization vector magnitude and direction relative to the RF signal propagation using relatively complicated magnetic structures. The magnetically tunable resonator shown in FIG. 1 is an example of one such structure.

The resonator shown in FIG. 1 is described in U.S. Pat. No. 6,141,571, issued to Dionne on Oct. 31, 2000 and assigned to the assignee of the present invention and hereby incorporated herein by reference in its entirety. Briefly, however, as shown in FIG. 1, magnetic tunability requires a single-crystal or quasi-single crystal ferrite 75 with additional structures including a demagnetizing gap 46, a wire coil 45, circuitry and power to generate a magnetic field H and a magnetization M. The requirement of additional external magnetic circuits increases the device cost and size, and the limitations on the magnetic structure cause fabrication and packaging problems in certain applications in which a relatively high level of integration is required. The magnetic structure is limited in some applications to either a continuous closed-loop configuration, for example in the shape of a toroid or a "window-frame" configuration. The external magnetic field H can interfere with the circuit performance of circuits having RF conductors fabricated from superconductor materials in certain applications. In addition, the speed at which the magnetization M can be switched in the ferrite device is somewhat limited by hysteresis and inductance. The concept of magnetically tuning ferrite resonators by applying a magnetic field to magnetize the ferrite is described in detail in the aforementioned U.S. Pat. No. 6,141,571.

It would, therefore, be desirable to provide a method and apparatus to control the gyromagnetic interaction between an RF signal and a magnetic structure without having to magnetize the magnetic structure. It would be further desirable to provide a tunable resonator which does not require additional external magnetic circuits or have limitations on the magnetic structure configuration.

SUMMARY OF THE INVENTION

In general, the present invention is directed to an electromagnetic device that comprises a magnetic structure suitable for gyromagnetic interaction with signals propagating along a signal path disposed sufficiently proximal to the magnetic structure such that an electromagnetic signal propagating along the signal path interacts gyromagnetically with a magnetization vector M of each domain in the domain pattern of the magnetic structure. A transducer controls a magnetization domain pattern in the magnetic structure which varies the propagation velocity of the signal in the region of gyromagnetic interaction.

In one embodiment, the signal path may be provided as a transmission line conductor in the form of a microstrip or a waveguide transmission line and the magnetic structure is provided as a planar structure. The domain pattern of magnetization vectors M of the magnetic structure is selected by adjusting the stress orientation applied by the transducer. This impacts the propagation velocity of the signal having linear polarization propagating along the transmission line path. In this manner, the present invention is operable as a switch or variable attenuator at the gyromagnetic resonance frequency, and as a variable reciprocal phase shifter or tunable filter away from the resonance frequency.

In accordance with one aspect of the present invention, a device responsive to an electromagnetic signal includes a conductor for conducting the electromagnetic signal, a magnetic structure disposed proximate the conductor to enable gyromagnetic interaction between the electromagnetic signal and the magnetic structure, and a transducer disposed on the magnetic structure for controlling a domain pattern in the magnetic structure. With such an arrangement, a device responsive to one or more signals in the microwave and millimeter wave frequency ranges is provided. By disposing the transducer on the magnetic structure, it is possible to change the domain pattern of the magnetic structure by causing the transducer to impart a force on the magnetic structure, thereby allowing operation and construction of the device without the use of relatively large external magnetic bias circuits. By eliminating the need for external magnetic bias circuits, the devices are smaller, lighter, less expensive, and have lower power requirements. Furthermore, the switching speeds are improved because there is low inductance. In one embodiment, the conductor is provided as a resonant circuit, and by selecting the resonance to occur at a predetermined frequency, the device can be used to provide RF filter circuits. The filter circuit characteristics can be adjusted by utilizing the transducer to change the domain pattern of the magnetic structure.

In accordance with a further aspect of the present invention, an electromagnetic device includes a conductor for conducting an electromagnetic signal applied thereto; a magnetostrictive magnetic structure comprised of a magnetic material, the structure being disposed in sufficient proximity to the conductor to enable gyromagnetic interaction between the signal and the structure in a region of gyromagnetic interaction, a piezoelectric substrate disposed on the magnetic structure for controlling a stress-oriented 180-degree magnetic domain pattern in the magnetic structure which varies the propagation velocity of the signal in the region of gyromagnetic interaction, and a plurality of electrodes disposed on opposing surfaces of the piezoelectric substrate for selectively activating a 180-degree domain pattern parallel to the propagation direction of the signal and selectively activating a 180-degree domain pattern perpendicular to the propagation direction of the signal. With this particular arrangement, a device having a resonant frequency that can be varied by varying an electric signal supplied to the piezoelectric substrate is provided. In this manner, a frequency response characteristic of the device can be controlled via a relatively simple electrical signal control circuit applying one or more signals via a plurality of electrodes without a relatively complicated magnetic circuit and corresponding control circuits.

In accordance with a further aspect of the present invention, a method for changing a propagation velocity of an electromagnetic signal propagating at a fixed frequency along a transmission line and interacting gyromagnetically with a magnetic structure having a plurality of magnetic domains, includes applying a force to the magnetic structure to vary the magnetic domain pattern of the magnetic structure to thereby change the propagation velocity of the electromagnetic signal and the amount (or degree) of gyromagnetic interaction. With such a technique, the gyromagnetic interaction between the electromagnetic signal and the magnetic structure can be controlled to change the propagation velocity of an electromagnetic signal without having magnetized the magnetic structure. Such a technique further provides a means for tuning a resonant circuit without providing an external magnetic field.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
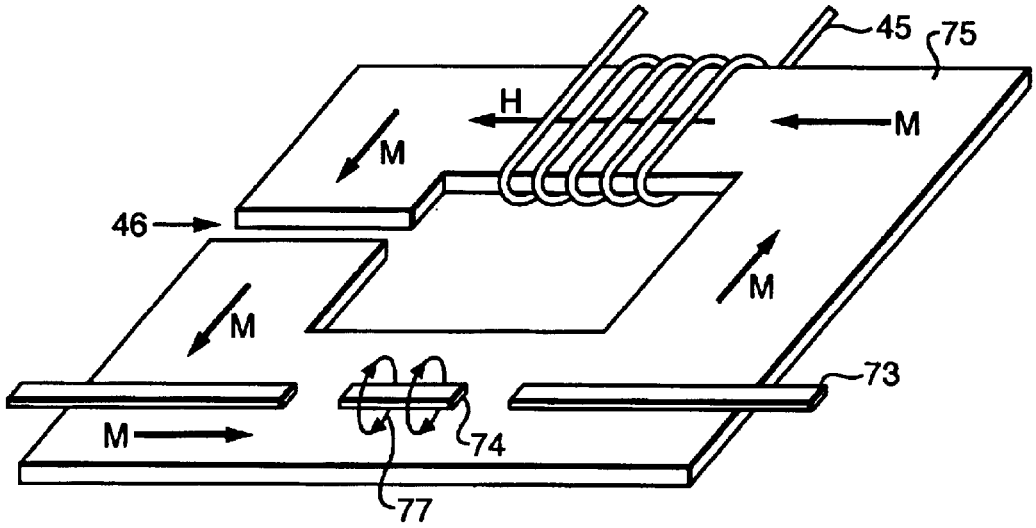
FIG. 1 (PRIOR ART)
FIG. 1 is a is a perspective view of a prior art magnetically tunable ferrite resonator.

Before providing a detailed description of the invention, it may be helpful to define some of the terms used in the description.

As used herein, the term "magnetic structure" refers to a spontaneous magnetic material, for example, a ferrimagnetic material or ferromagnetic material which interacts gyromagnetically with an electromagnetic signal as described below. A magnetostrictive material has the property of changing dimensions in the form of strains in response to a change in its state of magnetization. Magnetostrictive materials generally have an inverse magnetostrictive property wherein the directions of the magnetic moment vectors in magnetic structures comprising magnetostrictive material can be altered when a force applied to the structure causes strains in the material.

A "domain pattern" is a pattern of the magnetic domains in a magnetic structure. A "180-degree domain pattern" is a pattern in which an approximately first half of a plurality of the magnetic domains in a magnetic structure are aligned collinear with and opposed 180 degrees to an approximately second half of the plurality of domain fields. A "stripe domain pattern" is a 180-domain degree pattern which occurs in a planar magnetic structure. The magnetic domains can be thought of as being included in a volume having walls and in a 180-degree pattern the walls are parallel.

For purposes of the present invention, as used herein the term "conductor" refers to a signal path or transmission line which may be realized in a variety of ways including but not limited to a waveguide, a microstrip conductor, a stripline conductor, a wire, a cable, or other media suitable for propagation of an electromagnetic wave signal.

Note also that for purposes of the present discussion, the term "single crystal," when used to define a type of magnetic material, includes "quasi-single crystal" materials, which exhibit magnetic properties substantially similar to single crystals magnetized along easy axes. It will be appreciated by those of ordinary skill in the art that the use of a single crystal, quasi-single crystal, or a polycrystalline material is generally a design choice.

A "transducer" refers to any device which can be used to apply a mechanical force to the magnetic structure. The force acts over an area of the magnetic structure. "Stress" is defined as the ratio of the force to the area. The stress can be a tensile stress, pulling on the structure, or a compressive stress, pushing on the structure. The term "strain" refers to the relative change in dimensions of the structure. The strain can be a tensile strain when the structure is stretched or a compressive strain when the structure is compressed. The strain is proportional to the stress. A "piezoelectric material" is a material in which a strain results from the application of an electric field. A piezoelectric substrate can act as a transducer when the electric field is introduced into the substrate.

A "gyromagnetic effect" is an effect by which the magnetization of magnetic domains in a structure, subjected to a magnetostatic field precesses at an angle about the magnetostatic field at a rotational frequency proportional to the strength of the field, and upon disturbance from its equilibrium precessional angle relaxes back to equilibrium by damped precessional motion about the direction of that field. A gyromagnetic interaction is an interaction between an electromagnetic signal and a magnetic domain whereby a gyromagnetic effect (disturbance) occurs. A requirement for a gyromagnetic interaction is that the direction of the magnetic vector for the electromagnetic signal be perpendicular to the direction of the domain magnetization vector M.

Before proceeding with a discussion of FIGS. 2–5, the operation of an electromagnetic device operating in accordance with the present invention is first described in general overview. The present invention is directed to an electromagnetic device that employs a signal path conductor, a magnetic structure having a plurality of magnetic domains and a transducer. The signal path is disposed relative to the magnetic structure such that an electromagnetic signal propagating along the signal path interacts gyromagnetically with a magnetization vector M of each domain of the magnetic structure. Application of a signal to the transducer causes the transducer to apply a force on the magnetic structure which provides the magnetic structure having a particular domain pattern. The domain pattern of the magnetic structure is thus selected by adjusting the amplitude, a surface area upon which the force acts, and an orientation of the force applied by the transducer to the magnetic structure.

Changing the domain pattern of the magnetic structure can change the gyromagnetic effect in the device. Thus, the present invention finds application in any device, including but not limited to switches, phase shifters or tunable filters, whose operation depends upon the gyromagnetic effect.

Figure 2:
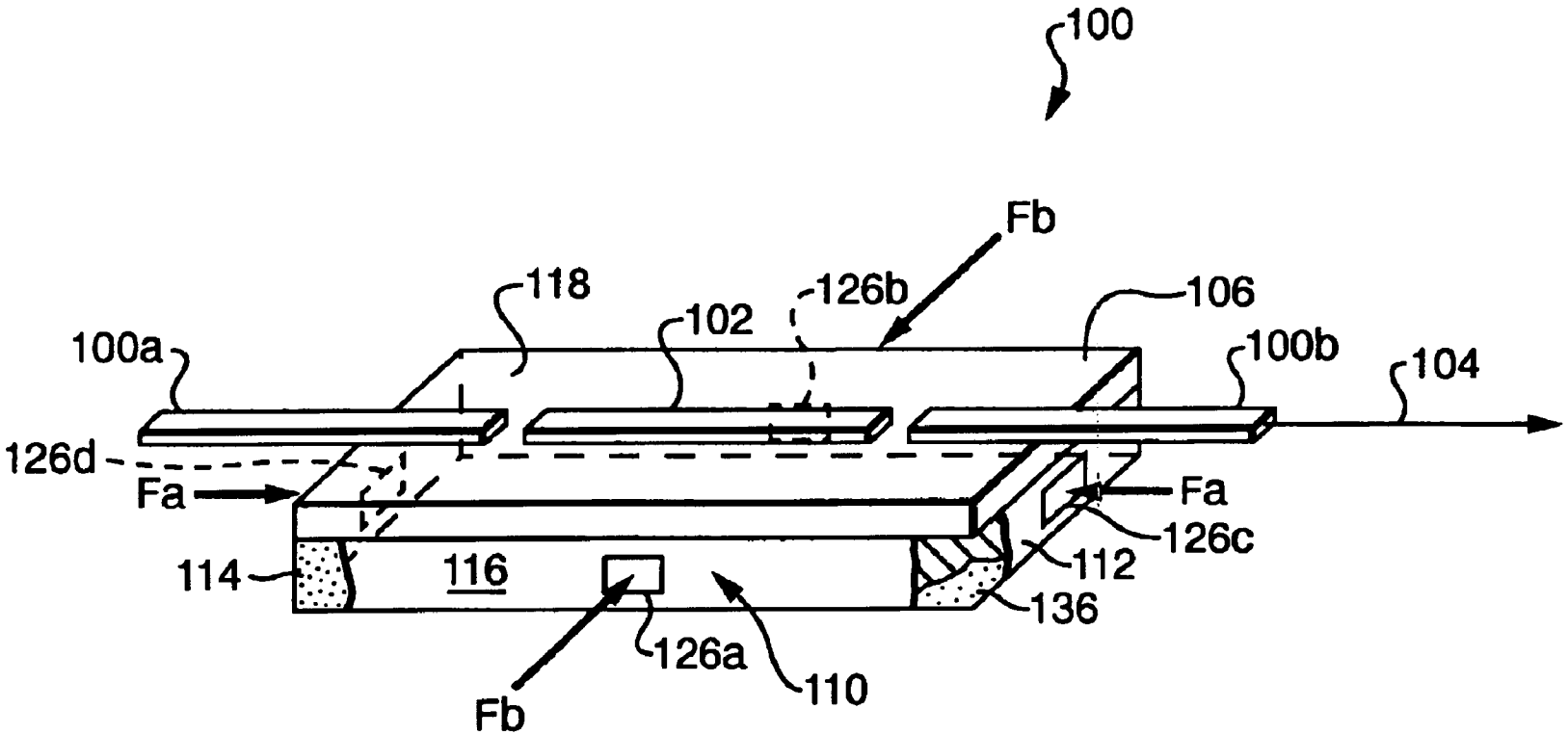
FIG. 2 is a perspective view of a tunable planar circuit resonator including a magnetic structure and a transducer according to the invention.

Referring now to FIG. 2, a device 100 having ports 100*a*, 100*b* and responsive to electromagnetic signals includes a conductor 102 disposed over a first surface of a magnetic structure 106. The conductor 102 is electromagnetically coupled between ports 100*a* and 100*b* of the device 100. The conductor 102 is provided such that at a predetermined frequency, the conductor 102 exhibits the characteristics of a resonant circuit to signals propagating between the ports

100*a*, 100*b*. One important property of the conductor 102 is electrical conductivity. Other properties of the conductor 102 such as thermal expansion coefficient, chemical composition, and method of fabrication are related to engineering design issues for specific applications and compatibility with the magnetic structure 106.

The magnetic structure 106 having a plurality of magnetic domains as will be described below in conjunction with FIGS. 2A–2E, is suitable for gyromagnetic interaction with signals propagating along a signal path such as that provided by the conductor 102. A second surface of the magnetic structure 106 is in turn disposed over a first surface of a transducer 110.

The transducer 110 includes a first pair of opposing side surfaces 112, 114 and a second pair of opposing side surfaces 116, 118. A plurality of transducer control contacts 126*a*–126*d* are disposed on the transducer side surfaces 112, 114 and 116, 118, respectively.

Portions of the transducer 110 have here been removed to reveal a ground plane 136 disposed over a second surface of the transducer 110. It should be noted that the ground plane can also be between the ferrite and the transducer (see FIG. 2). Thus, the signal path provided by conductor 102 is a conductor in the form of a transmission line (also referred to as a microstrip transmission line).

In operation in this particular example, an electromagnetic signal establishes a standing wave at a frequency resonant with the signal frequency in the conductor 102 in a line of signal propagation indicated by an arrow designated by reference numeral 104 in FIG. 2. It should be appreciated, of course, that electromagnetic signals can propagate in either direction between ports 100*a*, 100*b* of the device 100.

A requirement for providing a gyromagnetic effect is that a magnetic field component of the electromagnetic signals propagating along the conductor 102 be perpendicular to the magnetization vector M of the magnetic domains in the magnetic structure 106.

In one particular embodiment, the device 100 operating with electromagnetic signals having a nominal frequency of 10 GHz, the first surface of the magnetic structure 106 has approximate dimensions of 1" (in the line of signal propagation 104) by 0.5" and is 0.015" thick. The magnetic structure 106 has a dielectric constant of approximately 12.3, and the gaps between ports 100*a*–100*b* and conductor 102 are empirically determined.

The conductor 102 is here provided as a metal conductor bonded or otherwise coupled to the magnetic structure 106. It should be appreciated, of course, that the conductor 102 can be a superconductor to enhance performance and that the conductor 102 may be disposed over the magnetic structure 106 using any technique now or later-known to those of ordinary skill in the art. Such techniques include but are not limited to additive or subtractive processing techniques, injection molding techniques, sputtering, metal organic chemical vapor deposition (MOCVD), pulsed laser deposition (PLD) and liquid phase epitaxy (LPE). For example, conductor 102 may be provided by disposing over the magnetic structure 106 a thin or thick film substrate having the conductor 102 disposed there on. The film can be provided from a superconducting material or a relatively high temperature superconducting material such as yttrium-barium copper oxide or any other material that can be used to provide a relatively low loss transmission media to RF signals.

The magnetic structure 106, here a magnetostrictive magnetic material, is sufficiently proximal to the conductor 102 to enable gyromagnetic interaction between the signal and the magnetic structure 106 in a region of gyromagnetic interaction. In one embodiment, the magnetic material is a nickel (Ni) spinel ferrite having moderately strong stress sensitivity properties. In an alternate embodiment the magnetic material is an iron garnet ferrite having moderate stress sensitivity.

The details of the gyromagnetic interaction which occurs in devices manufactured and operating in accordance with the present invention are similar to an interaction obtained with magnetically tunable magnetic devices and as described in "Magnetic design for low-field tunability of microwave ferrite resonators," Dionne and Oates, Journal of Applied Physics, Vol. 85, Number 8, Apr. 15, 1999, which reference is hereby incorporated herein by reference. The magnetic material forming the magnetic structure 106 can be a single crystal, quasi-single crystal or a polycrystalline structure.

The transducer 110, here for example, a piezoelectric substrate imparts a force indicated by $F_a$ in FIG. 2 parallel to the line of signal propagation 104 of the signal when a voltage is applied to transducer control contacts 126*a*–126*b*. The transducer control contacts 126*a*–126*b*, here, are provided as electrodes bonded to or otherwise provided on the opposing surfaces 112 and 114 (not visible). Similarly, the transducer 110 imparts a force (indicated by $F_b$ in FIG. 2) to the magnetic structure 106 perpendicular to the line of signal propagation 104 of the RF signal when a voltage is applied to transducer control contacts 126*c*–126*d*. In, this example, the contacts 126*c*–126*d* are provided as electrodes bonded to opposing surfaces 116 and 118 (not visible) of the transducer 100. The transducer control contacts 126*a*–126*d* are bonded to or otherwise provided on the piezoelectric substrate and controlled using well known techniques. It will be appreciated by those of ordinary skill in the art that other transducers, including but not limited to force actuators, and microelectromechanical systems (MEMS) devices can also be used to apply controlled forces to the magnetic structure 106. The transducer can also be provided from a magnetostrictive material (e.g. a ferrite which does not have good microwave properties).

The magnetic structure 106 is coupled to the transducer 110. In one particular embodiment, for example, the magnetic structure 106 can be bonded to the transducer 110 using glue, epoxy or using a deposition technique in which a piezoelectric material is deposited on the second surface of the magnetic structure 106. Other techniques for coupling the magnetic structure 106 to the transducer 110 can also be used. In one alternative embodiment, for example, the electromagnetic device 100 comprises at least one thin film layer of magnetic material forming a magnetic structure 106 deposited on a piezoelectric substrate providing the transducer 110. In yet another alternate embodiment, a plurality of conductors 102 are disposed on a plurality of magnetic structures 106 which can be deposited on a single piezoelectric substrate. The forces provided by the single piezoelectric substrate are controlled by a plurality of electrodes arranged in array or an application dependent pattern In yet another alternate embodiment, a plurality of transducers 110 can be activated individually to provide the force on one or more magnetic structures.

One embodiment of the electromagnetic device 100 includes a magnetic structure 106 comprising conventional ferrimagnetic material such as nickel-aluminum spinel material having relatively strong inverse magnetostrictive properties sufficient to align magnetic domains and conventional piezoelectric materials which impart mechanical stress to the ferrite. It will be appreciated by those of ordinary skill in the art that other ferrimagnetic materials having inverse magnetostrictive properties including but not limited to yttrium-iron garnet families ($Y_3Fe_{5-x-y}Al_xIn_yO_{12}$, $Y_3Fe_{5-x-y}Ga_xIn_yO_{12}$, $Y_3Fe_{5-x-y}Al_xSc_yO_{12}$, $Y_3Fe_{5-x-y}Ga_xSc_yO_{12}$), calcium-vanadium garnet families ($Y_{3-2x}Ca_{2x}Fe_{5-x-y}V_xIn_yO_{12}$, $Y_{3-2x}Ca_{2x}Fe_{5-x-y}V_xSc_yO_{12}$, $Y_{3-2x-y}Ca_{2x+y}Fe_{5-x-y}V_xZr_yO_{12}$), lithium, nickel, manganese, and magnesium spinel ferrite families $Li_{0.5+t/2}Fe_{2.5-3t/2}Ti_tO_4$, $Li_{0.5-z/2}Zn_zFe_{2.5-z/2}O_4$, $Ni_{1-z}Zn_zFe_{2-x}Al_xO_4$, $Mn_{1-z}Zn_zFe_{2-x}Al_xO_4$, $Mg_1Fe_{2-x}Al_xO_4$ can provide the magnetic structure 106. Although, spinel ferrites have relatively strong inverse magnetostrictive properties, the magnetic material of the magnetic structure 106 need not be a ferrite. It will be appreciated by those of ordinary skill in the art that the magnetic structure 106 can be fabricated in a variety of shapes without the limitations of magnetically tunable devices, and in particular a planar shaped device 100 can provide a stripe domain pattern.

In one particular embodiment, a piezoelectric substrate 110 is controlled by voltages to impart an in-plane uniaxial stress for aligning and directing the activated 180-degree domain pattern. In this embodiment, the domain pattern is collinear with the uniaxial stress. The piezoelectric substrate 110 attached beneath the ferrite layer 106 imparts the desired strain to the magnetic structure simply by application of relatively small electrical voltage signals to transducer contacts 126*a*–126*d*. In this embodiment, a control circuit (not shown) is coupled to each of the plurality of electrodes 126, and the control circuit is adapted to selectively apply one or more signals to predetermined ones of the plurality of electrodes. In an alternate embodiment, the control circuit selectively applies a signal to each of a corresponding pair of said plurality of electrodes. The control circuit signals, for example, voltages can be determined and applied in a variety of techniques including but not limited to using a look-up table to provide a voltage signal, feedback circuits, real time processor computations or any other technique well known to those of ordinary skill in the art. The particular manner in which the voltages are determined and applied to the transducer in any particular application will be selected in accordance with a variety of factors, including but not limited to the physical properties of transducer, the construction of the electrodes and the desired range of gyromagnetic effect.

In operation, with no forces applied to the magnetic structure 106, the state of the magnetic domains in the magnetic structure 106 can be described as demagnetized assuming no hysteresis. When a force is applied to the magnetic structure 106 as a tensile stress or a compressive stress by the transducer 110 with corresponding tensile strain or compressive strain having a direction which is, for example, parallel to the line of signal propagation 104, an in-plane 180-degree domain pattern (described below in more detail in conjunction with FIGS. 2A and 2B) parallel to the line of signal propagation 104 is activated by the inverse magnetostrictive effect. Each domain in the 180-degree domain pattern has an associated M vector. The activation of the domain pattern changes the propagation velocity of the electromagnetic signal propagating along a transmission line provided by conductor 102.

When the force is imparted by the transducer 110 on the magnetic structure 106 perpendicular to the line of signal propagation 104, an in-plane 180-degree domain pattern perpendicular to the line of signal propagation 104 is activated. The plane of the in-plane 180-degree domain pattern is defined by the surface of a magnetic layer in the magnetic structure 106. The force provides the inverse magnetostrictive effect which polarizes the M vectors of the domains along a preferred axis in the magnetic structure 106.

In one embodiment, the forces $F_a$ and $F_b$, which can be either compressive or tensile forces, are selectively applied in directions parallel (FIG. 2C) and perpendicular (FIG. 2E) to the direction of signal propagation 104 to effectively rotate the 180-degree domain pattern. In this manner, a tunable resonator circuit is provided and the device 100 is operated as a filter having a frequency response characteristic which varies with the domain pattern.

In an alternate embodiment, the stress is applied and removed in only one direction, resulting in approximately one-half of the range of the maximum gryromagnetic effect because the domain directions will tend to randomize when the stress is removed so that some of the domains will still be contributing to the gyromagnetic effect. To remove the gryromagnetic effect entirely, the force is applied to align the M vectors of the domain pattern perpendicular to the line of signal propagation 104.

Figure 2A:
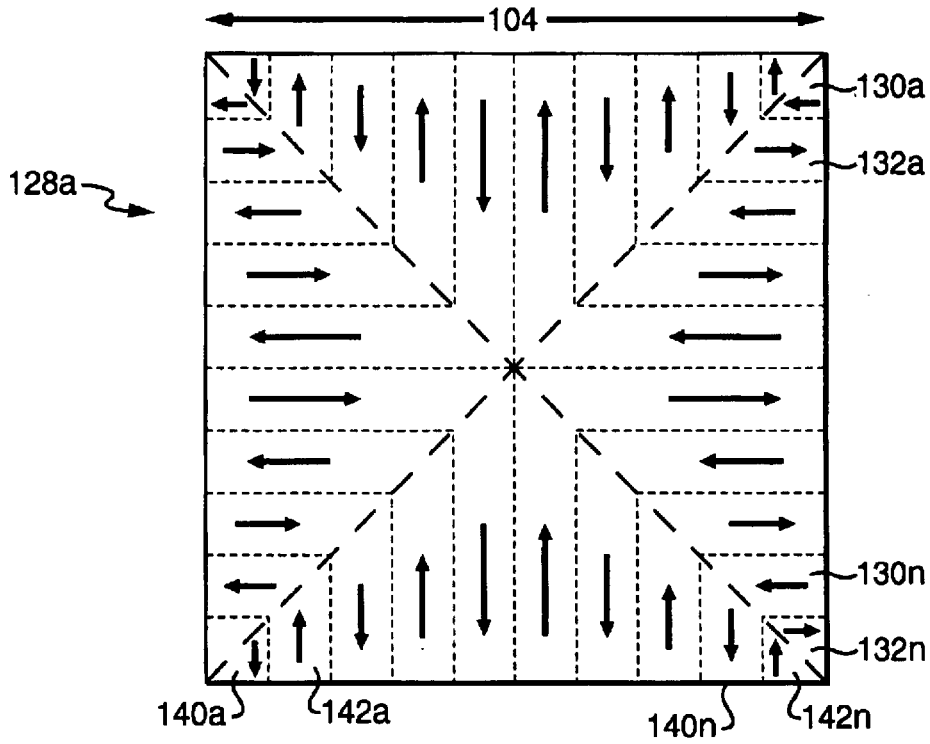
FIG. 2A is a schematic diagram of a 180-degree domain pattern in the magnetic substrate of FIG. 2 in an unstressed state.

Referring now to FIG. 2A, a 180-degree domain pattern 128*a* of the magnetic domains (the magnetization vectors in the magnetic structure 106 of FIG. 1) in an unstressed state includes a plurality of domain fields 130*a*–130*n* (generally referred to as domain fields 130) which are collinear with and opposed 180 degrees to a plurality of domain fields 132*a*–132*n* (generally referred to as domain fields 132) and an approximately equal plurality of domain fields 140*a*–140*n* (generally referred to as domain fields 140) which are collinear with and opposed 180 degrees to a plurality of domain fields 142*a*–142*n* (generally referred to as domain fields 142) Both of the domain fields 130 and 132 are aligned to the line of signal propagation 104. Both of the domain fields 140 and 142 are aligned perpendicular to the line of signal propagation 104. Even when the magnetic structure is in the unstressed state, the magnetic structure provides a gyromagnetic effect because of the remanent volume still aligned with the direction of propagation. The gyromagnetic effect is achieved when the RF magnetic field component is perpendicular to the M vector of the domains. For clarity, closure domains are not shown in FIGS. 2A–2E.

Figure 2B:
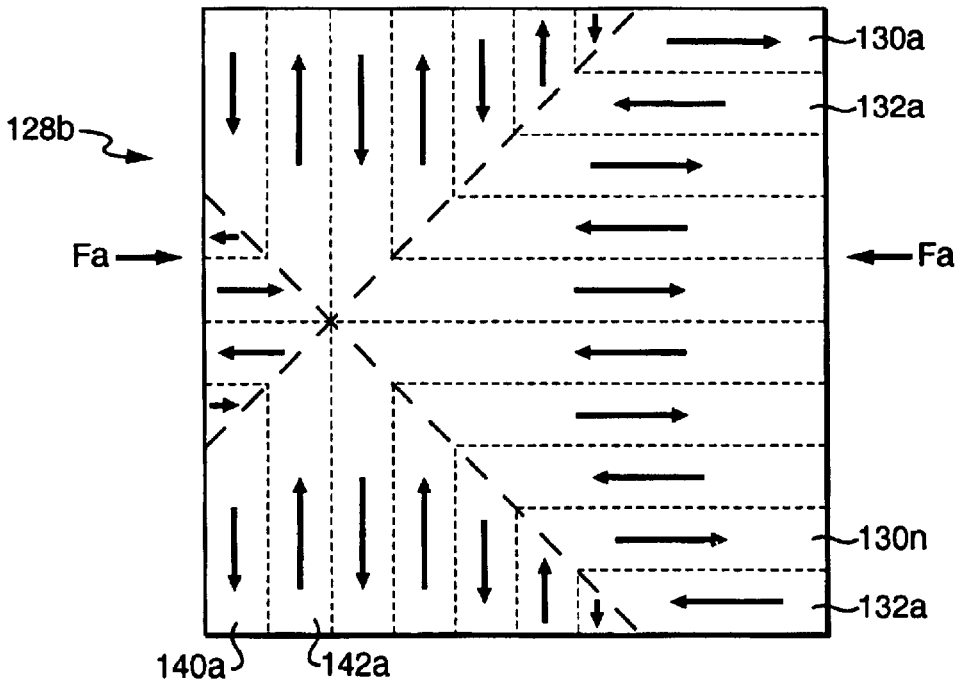
FIG. 2B is a schematic diagram of the 180-degree domain pattern in the magnetic substrate resulting from the strain from a moderate force applied to the magnetic substrate of FIG. 2 in a direction parallel to the direction of signal propagation.

Referring now to FIG. 2B in which like reference numbers indicate like elements of FIG. 2A, the 180-degree domain pattern 128*b* of the magnetic domains (the magnetization vectors in the magnetic structure 106 (FIG. 1)) is activated by a moderate stress force $F_a$, parallel to the line of signal propagation 104, and aligned in a 180-degree domain pattern having a plurality of domain fields 130 and 132 and an plurality of domain fields 140 and 142. In this state there is a larger volume of the magnetic structure having a plurality of domain fields 130 and 132 than the plurality of domain fields 140 and 142 in order to provide a moderate gyromagnetic effect. It will be appreciated by those of ordinary skill in the art that the force $F_a$ can provide a tensile stress, or a compressive stress resulting in a tensile strain or compressive strain on the magnetic structure respectively.

Figure 2C:
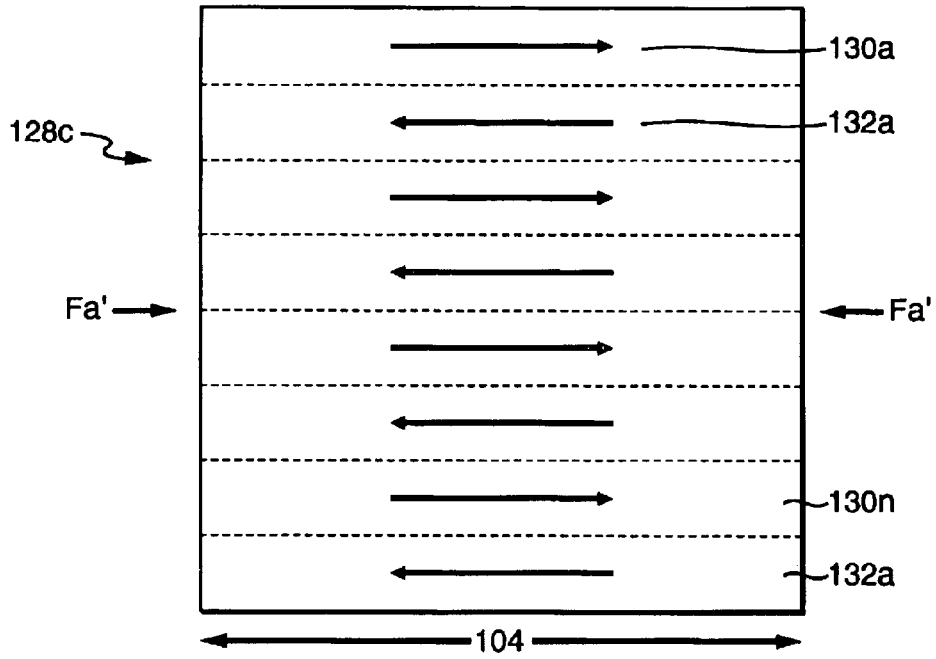
FIG. 2C is a schematic diagram of the 180-degree domain pattern in the magnetic substrate oriented parallel to the direction of signal propagation resulting from a relatively large force applied to the magnetic substrate of FIG. 2 in a direction parallel to the direction of signal propagation.

Referring now to FIG. 2C in which like reference numbers indicate like elements of FIG. 2A, the 180-degree domain pattern 128*c* of the magnetic domains (the magnetization vectors in the magnetic structure 106 (FIG. 1)) is activated by a relatively large force $F_a'$ and aligned in a 180-degree domain pattern having a plurality of domain fields 130 and 132 in order to provide the desired gyromagnetic effect. Both of the domain fields 130 and 132 are aligned to the line of signal propagation 104.

Figure 2D:
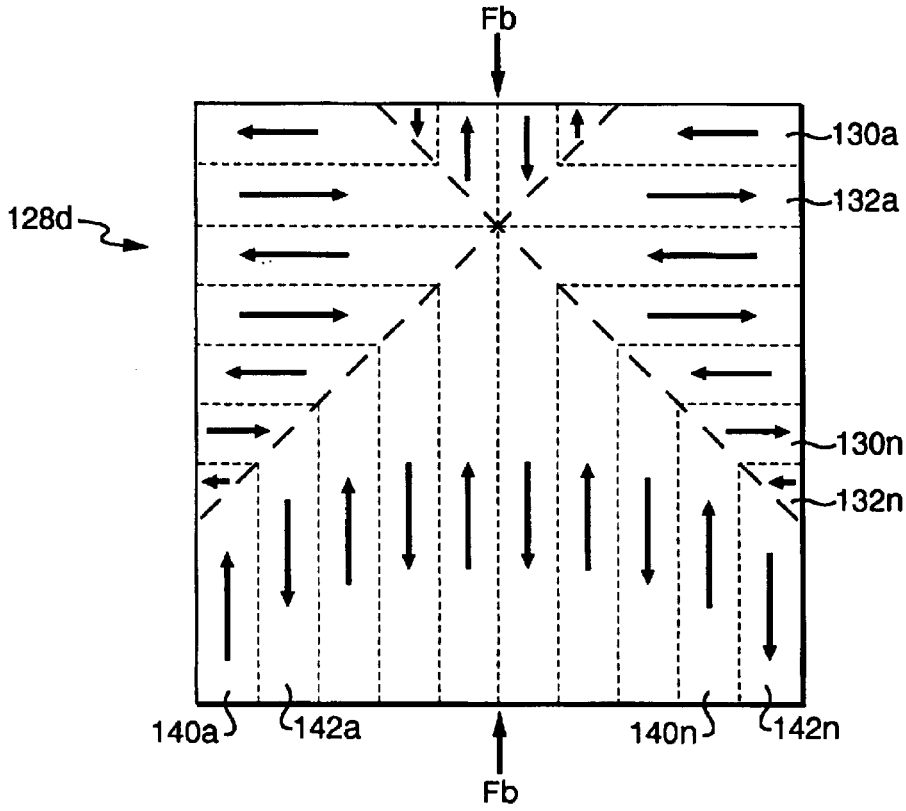
FIG. 2D is a schematic diagram of the 180-degree domain pattern in the magnetic substrate resulting from a moderate force applied to the magnetic substrate of FIG. 2 in a direction perpendicular to the direction of signal propagation.

Referring now to FIG. 2D in which like reference numbers indicate like elements of FIG. 2A, the 180-degree domain pattern 128*d* of the magnetic domains (the magnetization vectors in the magnetic structure 106 (FIG. 1)) is activated by a moderate force $F_b$, aligned to the line of signal propagation 104, and aligned in a 180-degree domain pattern having a plurality of domain fields 130 and 132 and a plurality of domain fields 140 and 142. In this state there is a larger volume of the magnetic structure having a plurality of domain fields 140 and 142 than the plurality of domain fields 130 and 132 in order to provide a moderate gyromagnetic effect. It will be appreciated by those of ordinary skill in the art that the force $F_b$ can provide a tensile stress, or a compressive stress resulting in a tensile strain or compressive strain on the magnetic structure respectively.

Figure 2E:
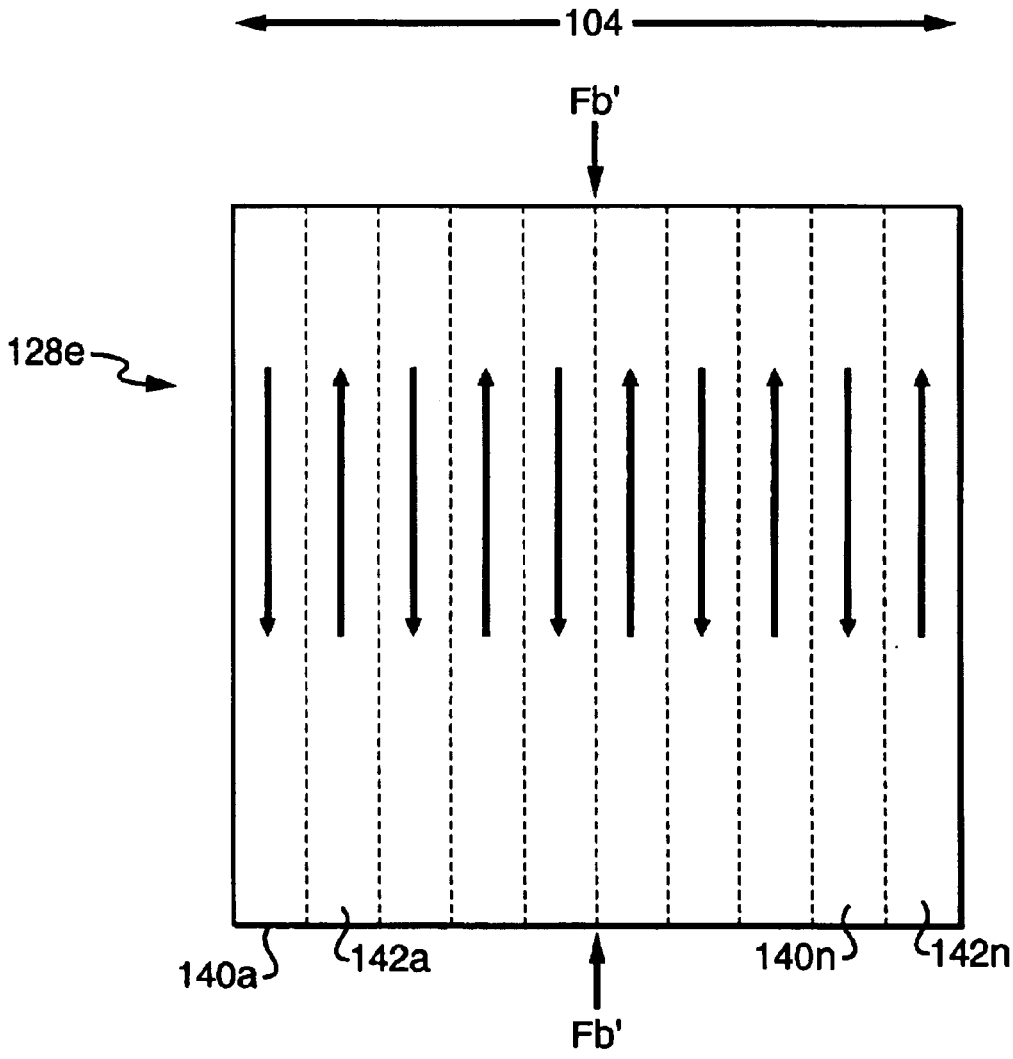
FIG. 2E is a schematic diagram of the 180-degree domain pattern in the magnetic substrate oriented perpendicular to the direction of signal propagation from a relatively large force applied to the magnetic substrate of FIG. 2 in a direction perpendicular to the direction of signal propagation.

Referring now to FIG. 2E in which like reference numbers indicate like elements of FIG. 2A, the 180-degree domain pattern 128*e* of the magnetic domains (the magnetization vectors in the magnetic structure 106 (FIG. 1)) is activated by a relatively large force $F_b'$ and aligned in a 180-degree domain pattern having a plurality of domain fields 140 and 142 in order to provide the desired gyromagnetic effect. Both of the domain fields 140 and 142 are aligned perpendicular to the line of signal propagation 104.

In one particular embodiment, the 180-degree domain pattern is rotated between directions parallel 128*c* (FIG. 2C) and perpendicular 128*e* (FIG. 2E) to the RF magnetic field component in the line of signal propagation 104 in the material to achieve a variable gyromagnetic effect. The domain pattern is rotated by rotating the force applied to the magnetic structure 106, for example, by selectively applying a time varying voltage pattern to the plurality of transducer control contacts 126*a*–126*d* (FIG. 2).

In one embodiment, the magnetic structure 106, comprises a material which requires a relatively small amount of strain to control a domain pattern in the magnetic structure 106. In another embodiment, the magnetic structure 106, comprises a polycrystalline material which includes some hysteresis to provide some resistance to avoid a two-state flipping of the domain pattern between two states as relatively small forces are applied to the magnetic structure 106. In an alternate embodiment, resistance to flipping the domain pattern between two states is provided by the magnetic structure 106 from a single crystal material with magnetic anisotropy in the plane of the domain rotation.

The separation between the domains (referred to as walls) move in accord with the preferred direction of magnetization imposed by the stress. Achieving a continuous range of domain alignments requires some intrinsic anisotropy of the magnetic material, otherwise there would be no intermediate states between fully parallel and fully perpendicular to the line of signal propagation. In one embodiment, the domain pattern has 180-degree domains of varying lengths. The walls exist only between regions of different magnetic vector directions, here the vectors exhibit a complete reversal and are opposed 180 degrees. The respective volumes of the reversed domains need not be equal. It will be appreciated by those of ordinary skill in the art, there could be other methods to produce an equivalent effect on the domains, resulting in the 180-degree pattern, e.g., an alternate stress orientation or method of application.

An unmagnetized ferrite with a 180-degree domain pattern aligned at the desired angle to the propagation direction is sufficient to produce the necessary reciprocal gyromagnetic interaction. With the proper choice of ferrite material, the inverse magnetostrictive effect can be used to align magnetic domains. A rotatable uniaxial in-plane stress can accomplish the same net effect on the microwave propagation as a conventional rotatable magnetizing field, as indicated in FIG. 1A.

Figure 3:
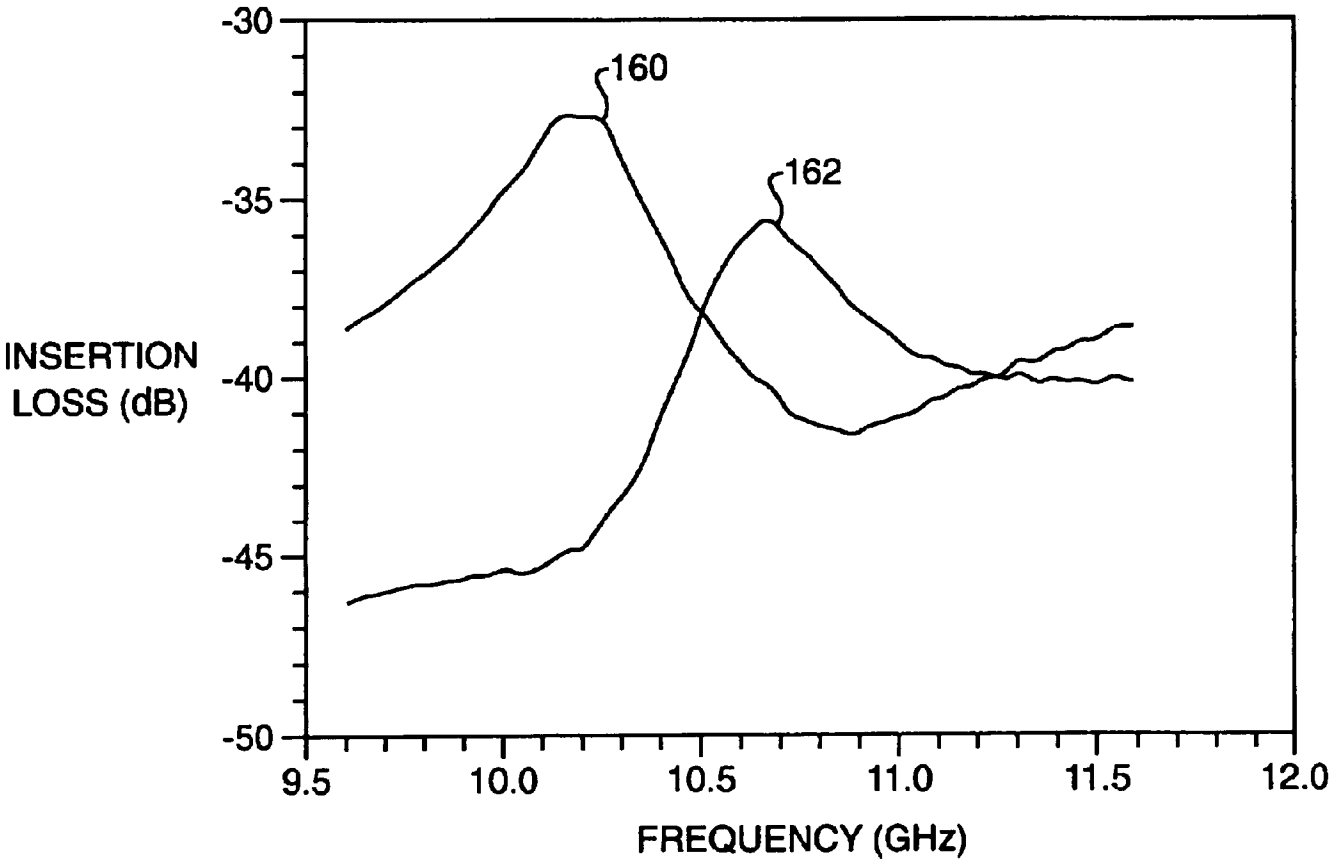
FIG. 3 is a plot of insertion loss vs. frequency for two magnetic states of the substrate: unstressed, and under an applied stress parallel to the signal propagation, in accordance with the present invention.

FIG. 3 is a plot of experimentally measured insertion loss (dB) of a resonant circuit vs. frequency (GHz) for the tunable resonator circuit shown in FIG. 2 illustrating two magnetic states of the substrate: (i) unstressed and (ii) under a moderate applied stress parallel to the propagation direction of the signal. The resonant frequency of the unstressed resonator as shown by curve 160 is approximately 10.2 GHz. When a relatively small stress is applied for activating the 180-degree domain pattern, the resonant frequency increases to 10.7 GHz as shown by curve 162. Further enhancement of tunability, by providing a greater gyromagnetic interaction, can be realized through applying greater force using for example a piezoelectric substrate.

Figure 4:
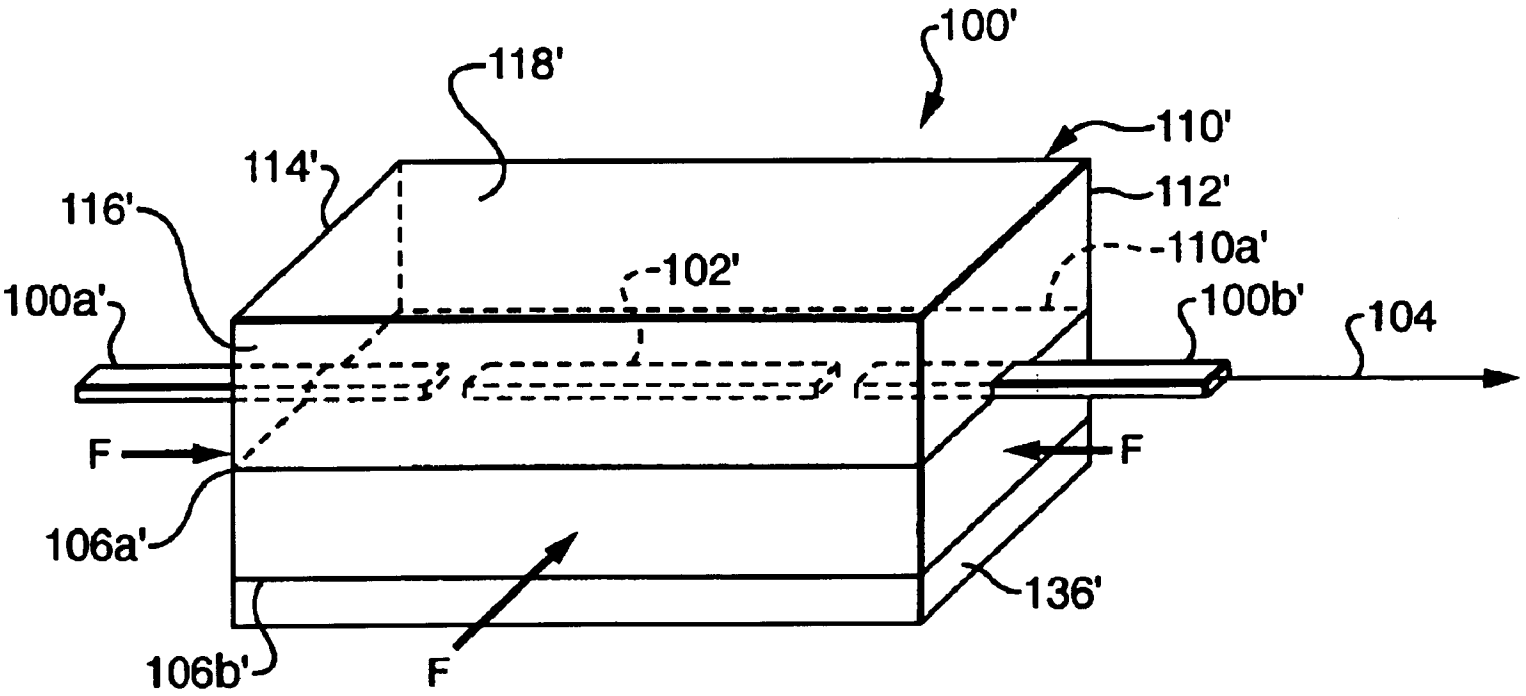
FIG. 4 is a perspective view of an alternate embodiment of a tunable planar circuit resonator including a conductor disposed between a magnetic structure and a transducer according to the invention.

Referring now to FIG. 4 in which like reference numbers of FIG. 2 indicate like elements, an alternate embodiment electromagnetic device 100' (similar to the electromagnetic device 100 of FIG. 2) having ports 100*a*', 100*b*' and responsive to electromagnetic signals, includes a transducer 110' having a first surface 110*a*', a magnetic structure 106' having a first surface 106*a*' and a second surface 106*b*', and a ground plane 136' disposed adjacent to the second surface 106*b*'. The device further includes a conductor 102' disposed between the first surface 110*a*' of the transducer 110' and the first surface 106*a*' of the magnetic structure 106'. The conductor 102' is electromagnetically coupled to ports 100*a*' and 100*b*' which are disposed on the transducer 110'. The transducer 110' includes a first pair of opposing surfaces 112', 114' and a second pair of opposing surfaces 116', 118'. A plurality of transducer control contacts (not shown) are disposed on the transducer surfaces 112', 114' and 116', 118', respectively. In this particular example, an RF signal propagates along the conductor 102' in a line of signal propagation indicated by arrow and reference numeral 104. In one embodiment, the conductor 102' is disposed in a groove (not shown) in the transducer 110'.

Figure 5:
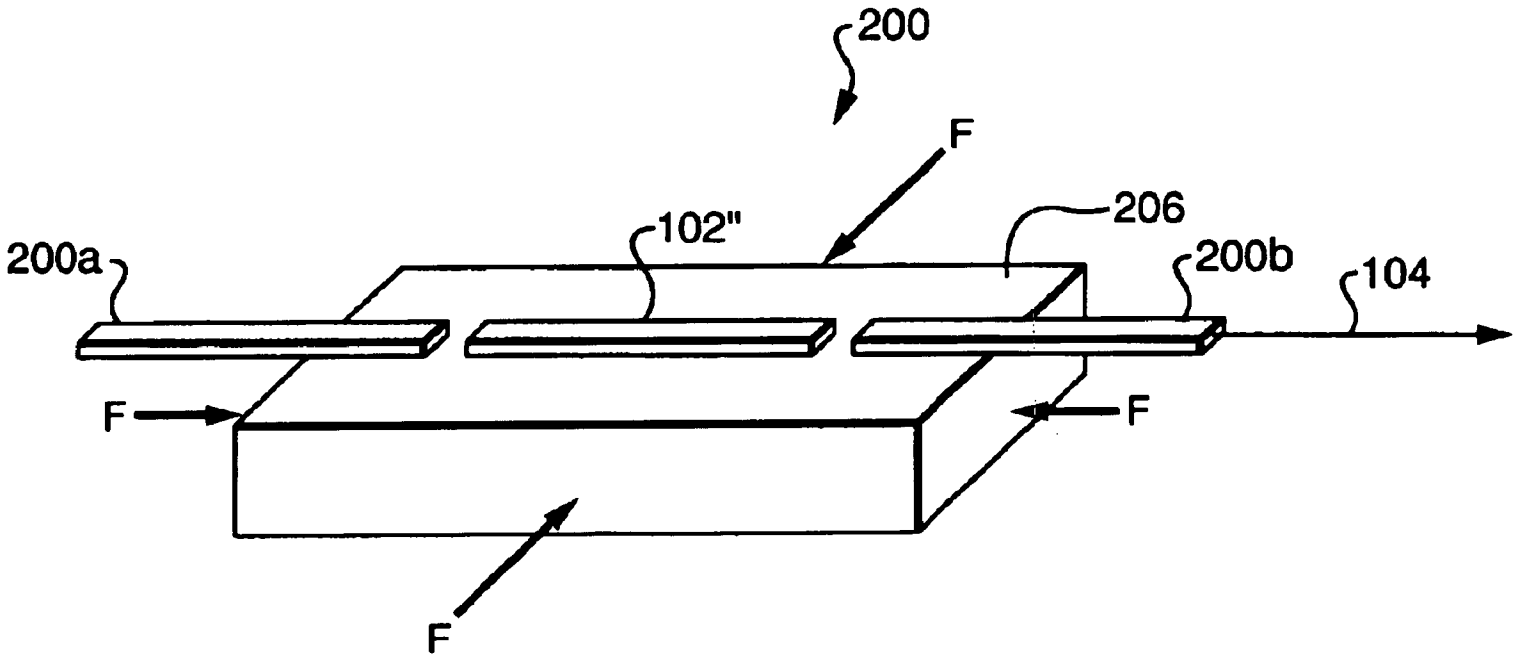
FIG. 5 is a perspective view of an alternate embodiment of a tunable planar circuit resonator including a monolithic transducer and magnetic structure according to the invention.

Referring now to FIG. 5 in which like reference numbers of FIG. 2 indicate like elements, a device 200 having ports 200*a*, 200*b* and responsive to electromagnetic signals includes a conductor 102" disposed over a first surface of a monolithic substrate 206. The monolithic substrate 206 provides a magnetic structure and a transducer. The monolithic substrate 206 is disposed on a ground plane (not shown). The device 200 operates similarly to the embodiments shown in FIGS. 2 and 4, but the device 200 does require a separate fabrication process to bond a transducer to a magnetic structure. In one embodiment, the monolithic substrate 206 is, for example, a ferrimagnetic material having piezoelectric properties.

All publications and references cited herein are expressly incorporated herein by reference in their entirety.

Having described the preferred embodiments of the invention, it will now become apparent to one of ordinary skill in the art that other embodiments incorporating their concepts may be used including but not limited to isolators, phase shifters, tunable filters, variable attenuators, modulators and switches. It is felt therefore that these embodiments should not be limited to disclosed embodiments but rather should be limited only by the spirit and scope of the appended claims.

What is claimed is:

1. A device responsive to an electromagnetic signal, the device comprising:

(a) a conductor for conducting the electromagnetic signal;

(b) a magnetic structure having a magnetic domain pattern, said magnetic structure disposed proximate said conductor to enable gyromagnetic interaction between the electromagnetic signal and said magnetic structure; and (c) a transducer disposed on said magnetic structure to control the magnetic domain pattern in said magnetic structure.

2. The device of claim 1 wherein said magnetic structure comprises a magnetostrictive material.

3. The device of claim 2 wherein the magnetostrictive material comprises a ferrimagnetic material.

4. The device of claim 2 wherein the magnetostrictive material comprises a ferromagnetic material.

5. The device of claim 1 wherein said transducer comprises at least one of a piezoelectric substrate, An electrostrictive substrate and a magnetostrictive substrate.

6. The device of claim 5 wherein said piezoelectric substrate further comprises a plurality of electrodes disposed on said piezoelectric substrate.

7. The device of claim 6 further comprising a control circuit coupled to each of said plurality of electrodes, said control circuit adapted to apply one or more signals to predetermined ones of said plurality of electrodes.

8. The device of claim 7 wherein said control circuit selectively applies one of the one or more signals to each of a corresponding pair of said plurality of electrodes.

9. The device of claim 1 wherein the domain pattern comprises a 180-degree domain pattern.

10. The device of claim 9 wherein said magnetic structure is provided having a planar shaped structure and the domain pattern comprises a stripe domain pattern.

11. The device of claim 1 wherein said conductor comprises a superconductor.

12. The device of claim 1 wherein said conductor comprises a resonant circuit.

13. The device of claim 1 wherein said conductor corresponds to a resonator structure such that the device operates as a filter having a frequency response characteristic which varies with the domain pattern.

14. The device of claim 1 wherein said transducer is adapted to apply a force on said magnetic structure to control the domain pattern in said magnetic structure.

15. The device of claim 14 wherein said transducer is adapted to apply a compression force on said magnetic structure to control the domain pattern in said magnetic structure.

16. The device of claim 14 wherein said transducer is adapted to apply a tension force on said magnetic structure to control the domain pattern in said magnetic structure.

17. The device of claim 1 wherein said magnetic structure and said transducer are provided in a monolithic substrate.

18. A method for changing a propagation velocity of an electromagnetic signal propagating at a first frequency along a transmission line in the vicinity of a magnetic structure having a plurality of magnetic domains, the method comprising: applying a force to the magnetic structure to vary a pattern of the magnetic domains of the magnetic structure to thereby change the propagation velocity of the electromagnetic signal in the region of gyromagnetic interaction.

19. The method of claim 18 wherein applying the force comprises applying a uniaxial stress parallel to the line of signal propagation of the electromagnetic signal.

20. The method of claim 18 wherein applying a force further comprises orienting a plurality magnetic domains disposed in the magnetic structure, over a range of orientations between parallel and perpendicular to a line of signal propagation of the electromagnetic signal.

21. The method of claim 18 wherein the magnetic structure corresponds to a ferrite.

22. An electromagnetic device comprising:

(a) a magnetic structure having first and second opposing surfaces and a first magnetic domain pattern;

(b) a transducer having first and second opposing surfaces, with a first one of the first and second opposing surfaces disposed over a first one of the first and second surfaces of said magnetic structure, said transducer for imparting a force onto said magnetic structure, to thereby change the magnetic domain pattern of said magnetic structure from the first magnetic domain pattern to a second different magnetic domain pattern; and (c) a resonator disposed between the first one of the surfaces of said magnetic structure and the first one of the surfaces of said transducer, said resonator responsive to signals at a predetermined frequency.

23. The electromagnetic device of claim 22 wherein said transducer comprises a piezoelectric substrate.

24. The electromagnetic device of claim 22 wherein said magnetic structure comprises at least one of:

a ferromagnetic material; and a ferrimagnetic material.

25. The electromagnetic device of claim 24 wherein magnetic structure corresponds to a ferrite.

26. The electromagnetic device of claim 22 further comprising a control circuit coupled to said transducer, said control circuit adapted to apply a signal to said transducer such that said transducer changes at least one magnetic domain in said magnetic structure.

27. The electromagnetic device of claim 22 wherein said resonator interacts with said magnetic structure for providing the device having a gyromagnetic interaction.

28. The electromagnetic device of claim 22 wherein said transducer further comprises a groove disposed in the transducer adjacent the first surface of the transducer; and wherein the resonator is disposed in the groove.

* * * * *

UNITED STATES PATENT AND TRADEMARK OFFICE

CERTIFICATE OF CORRECTION

PATENT NO. : 6,919,783 B2
APPLICATION NO. : 10/131338
DATED : July 19, 2005
INVENTOR(S) : Gerald F. Dionne et al.

It is certified that error appears in the above-identified patent and that said Letters Patent is hereby corrected as shown below:

Column 8,
Line 58, delete "pattern In yet" and replace with -- pattern. In yet --.

Column 9,
Line 11, delete "$Li_{o\ 5+t/2}$" and replace with -- $Li_{o.5+t/2}$ --.
Line 44, delete "of transducer," and replace with -- of the transducer, --.

Column 10,
Line 50, delete "and an plurality" and replace with -- and a plurality --.

Column 12,
Line 13, delete "using for example a" and replace with -- using, for example, a --.

Column 13,
Line 8, delete "An" and replace with -- an --.

Column 14,
Line 5, delete "plurality magnetic" and replace with -- plurality of magnetic --.

Signed and Sealed this

Twentieth Day of June, 2006

JON W. DUDAS
*Director of the United States Patent and Trademark Office*